United States Patent [19]

Hirsch

[11] 4,182,186

[45] Jan. 8, 1980

[54] NOTCHING MECHANISM

[76] Inventor: Louis W. Hirsch, 411 Windsor Rd., Englewood, N.J. 47631

[21] Appl. No.: 890,975

[22] Filed: Mar. 28, 1978

[51] Int. Cl.[2] ..... B26D 3/14

[52] U.S. Cl. ..... 83/467 R; 83/524; 83/543; 83/582; 83/589; 83/602; 83/917

[58] Field of Search ..... 83/467, 414, 524, 543, 83/582, 583, 602, 693, 917

[56] References Cited

U.S. PATENT DOCUMENTS

| | | | |
|---|---|---|---|
| 365,517 | 6/1887 | Hazen . | |
| 937,865 | 10/1909 | Rohde | 83/583 |
| 1,302,398 | 4/1919 | Mangini | 83/583 X |
| 1,962,023 | 6/1934 | Mann . | |
| 2,255,846 | 9/1941 | Grammer | 83/582 |
| 2,707,996 | 5/1955 | Kalb . | |
| 3,371,569 | 3/1968 | Pearson et al. . | |
| 3,741,053 | 6/1973 | Byrne et al. . | |
| 3,765,293 | 10/1973 | Fries et al. | 83/543 X |
| 3,812,753 | 5/1974 | Kiejzik | 83/583 X |
| 3,850,067 | 11/1974 | Davey | 83/524 |
| 3,988,829 | 11/1976 | Sumida . | |

FOREIGN PATENT DOCUMENTS

| | | | |
|---|---|---|---|
| 501583 | 11/1954 | Italy | 83/582 |

*Primary Examiner*—J. M. Meister

*Attorney, Agent, or Firm*—Oblon, Fisher, Spivak, McClelland & Maier

[57] ABSTRACT

A notching mechanism for objects which includes a base and an upright support secured to and vertically projecting from the base. A member for supporting an object(s) to be notched is also mounted on the base adjacent to the upright support, first and second cooperating cutting members, the first cutting member being fixedly secured to the base and the second member being connected to the upright support. A member for reciprocating the second cutting member is mounted to the upright support so as to operatively cooperate with the first cutting member and thereby form a notch in the object(s). Moreover, the member for reciprocating the second cutting member is characterized either by a carriage member, to which the second cutting member is operably secured, including an orifice provided therein and a cam member disposed within the orifice for engaging the carriage member so as to automatically reciprocably drive the second cutting member during a revolution of the cam means or a carriage member to which the second cutting member is operably secured which includes a member for operably engaging the carriage so as to reciprocably drive the second cutting member.

9 Claims, 11 Drawing Figures

NOTCHING MECHANISM

BACKGROUND OF THE INVENTION

1. Field of the Invention

This invention relates to a notching mechanism which is automatically operable by a switch.

2. Description of the Prior Art

In a conventional manual notching mechanism, a wheel-like blade structure is provided which is shaped substantially as a disc having a substantially flat circumscribing periphery with a notch therein forming the blade, and with each of opposite ends of the disc extending axially in substantially conical shapes and being biased in an upward blade position, having a handle structure for manually rotating the disc in a downwardly blade-cutting direction against a biasing spring. Such notching mechanism is also characterized by a spring-biased key for snap-in releasable engagement of a slidable mounting plate, for an object to be notched, in each of a number of designated notching positions so as to intermittently hold the slidable mounting plate in a fixed position during a manual notching operation.

SUMMARY OF THE INVENTION

Accordingly, it is an object of the present invention to provide a notching mechanism which utilizes a reciprocating cutting member in connection with a second fixed cutting member.

It is another object of the present invention to provide a notching mechanism which is automatically controlled so as to provide a single cycle notching operation.

It is a further object of the present invention to provide for biasing of a first and second cutting member into cooperating engagement and for shifting a first cutting member from cooperative engagement with the second cutting member when the cutting force of the notching mechanism is less than the cutting force necessary to notch an object so as to overload the cutter assembly.

It is an additional object of the present invention to provide an axially shiftable indexing carriage in connection with a notching mechanism.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

Figure 1:
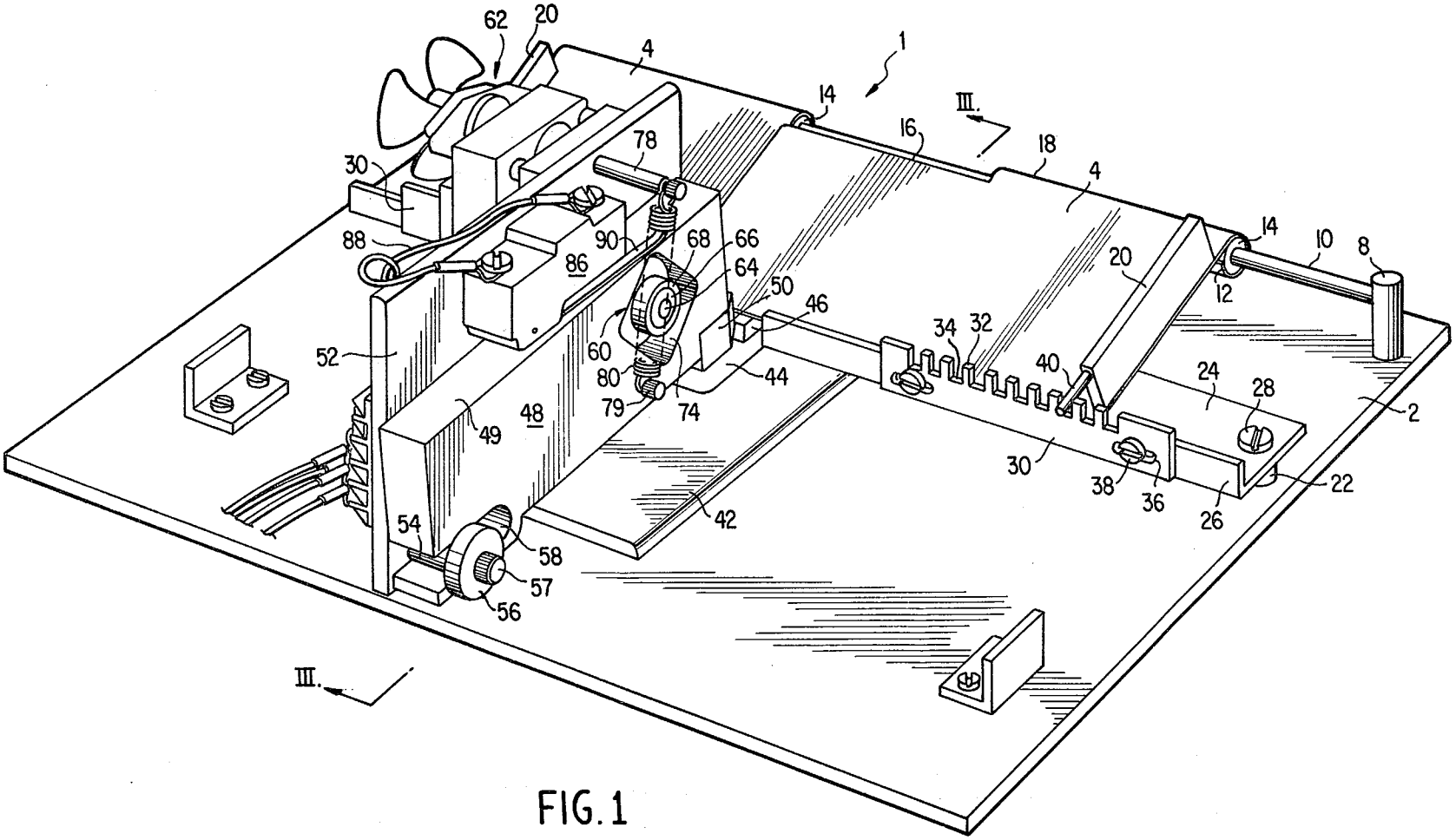
FIG. 1 is a perspective view of a first embodiment of the present invention.
Figure 5:
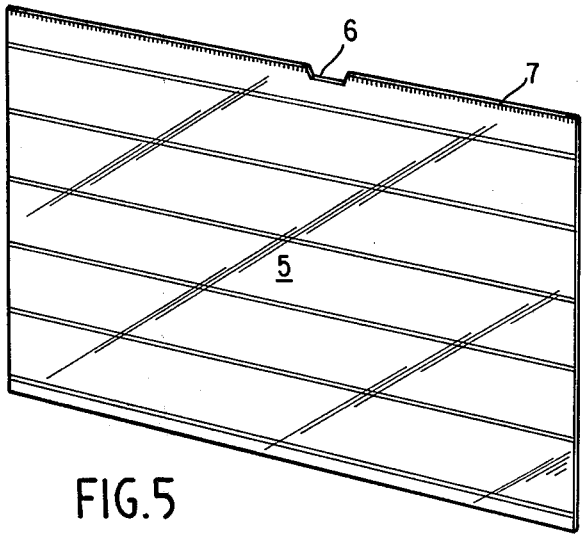
Figure 4:
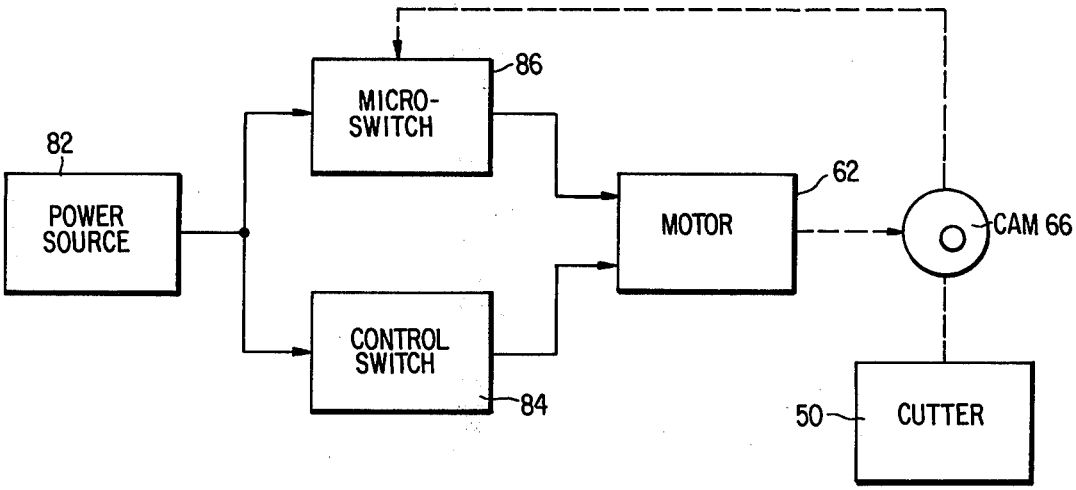
Figure 6:
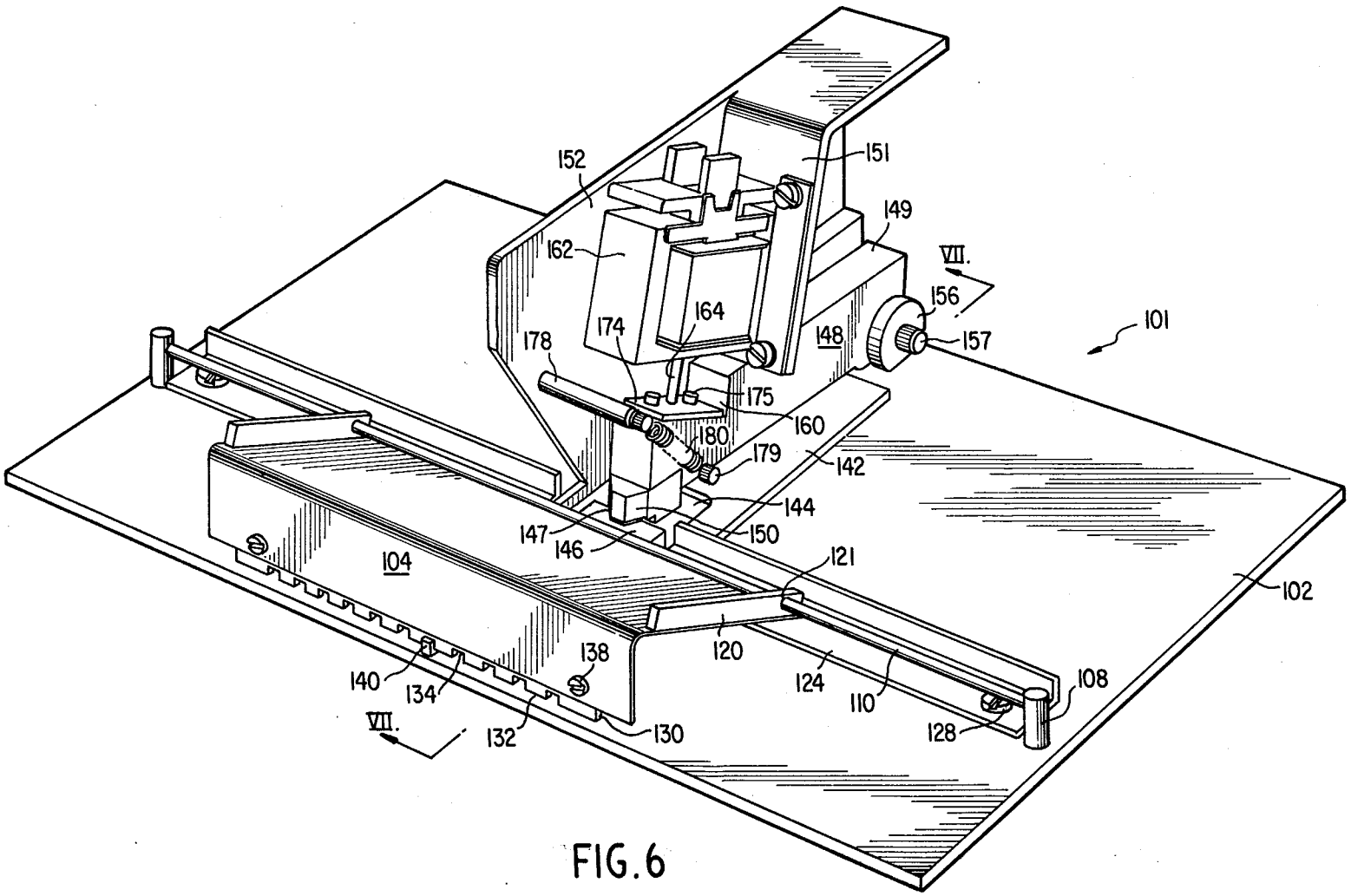

FIGS. *3a, 3b, 3c* are sectional views taken along lines III—III of FIG. 1 and explain the operation of the notching or cutting portion of the notching mechanism of FIG. 1;

FIG. 4 illustrates the control circuitry of the notching mechanism of FIG. 1;

FIG. 5 is a perspective view of an object notched by the notching mechanism of FIG. 1;

FIG. 6 is a perspective view of a second embodiment of the present invention; and, FIGS. *7a, 7b,* and *7c* are sectional views taken along lines VII—VII of FIG. 1 explaining the operation of the notching or cutting portion of the notching mechanism shown in FIG. 6.

DETAILED DESCRIPTION OF THE PREFERRED EMBODIMENTS

In FIGS. 1–5, there is shown a notching mechanism 1 which includes a base or frame member 2 upon which is mounted indexing carriages 4 for supporting an object 5 to be notched such as, for example, one or more microfilm jackets, aperture cards, diazo fiche or data processing cards. An object 5 as shown in FIG. 5 is provided with a notch 6 along the color coded edge portion 7 of the object for the purpose of providing, for example, a color coded index system so that a grouping of identically notched objects together provide a notched area which shows up as a recess in a colored field. As a result, a misfiled object shows up in the recess such that the misfiled object can be readily identified and properly refiled.

Figure 2:
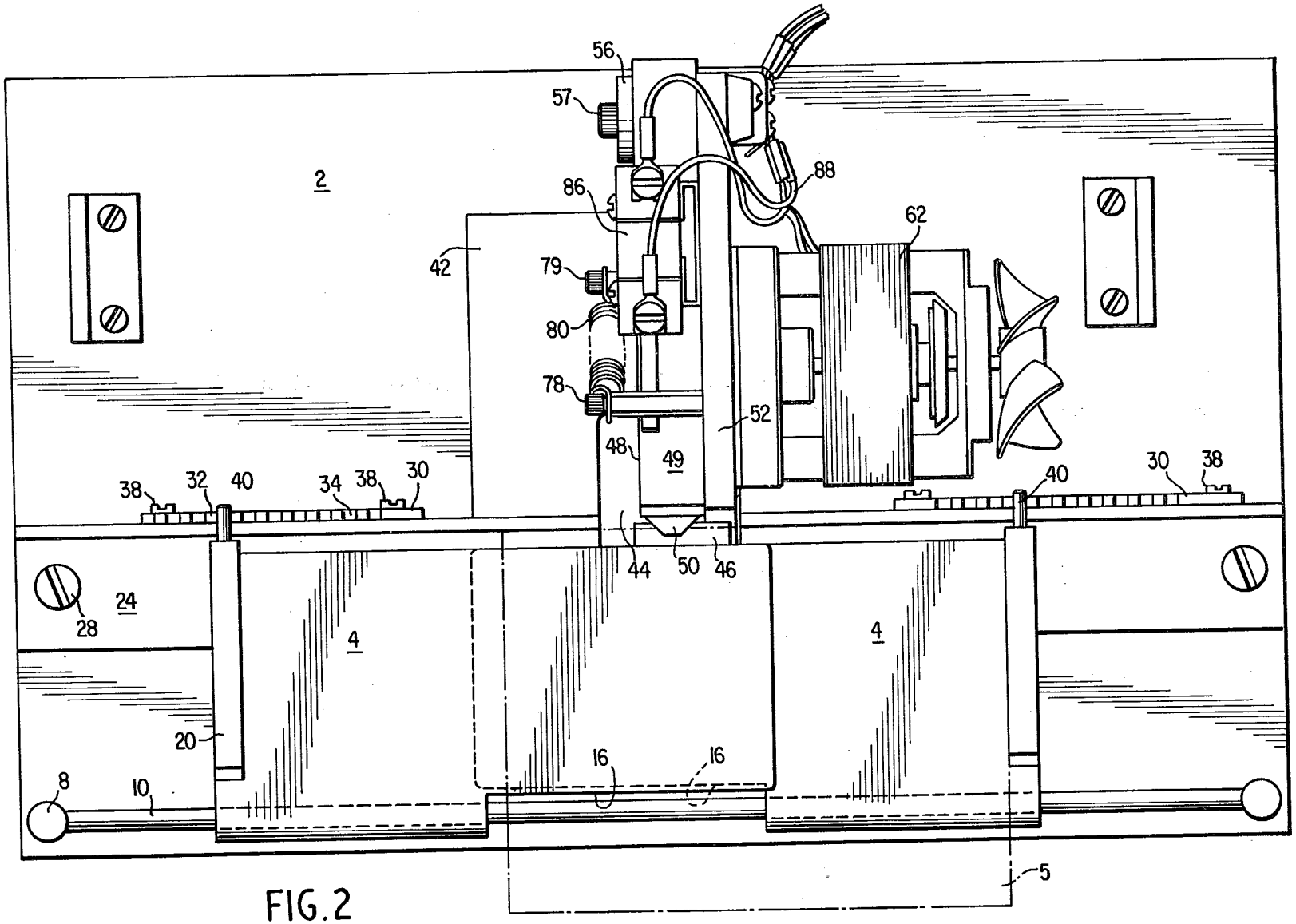
FIG. 2 is a top view of the notching mechanism shown in FIG. 1.

Notching mechanism 1 is also provided with a pair of post or column members 8 which vertically project from the horizontal base or frame member 2 and serve to interconnect opposite ends of a rod 10. A pair of indexing carriages 4 are slidably mounted upon rod 10 by means of a curved flange edge portion 12 with a bearing member 14 being secured within curved flange 12. Indexing carriages 4 are also provided with inner edge portions 16 and outer edge portions 18 disposed at opposite ends of each of the indexing carriages so as to allow for overlapping of one index carriage with respect to the other as shown in FIG. 2.

Each indexing carriage has an abutment member 20 mounted thereto at opposite end portions, respectively, and is formed by rectangular shaped plates vertically projecting from the surface of each index carriage.

Base or frame member 2 also includes a second pair of posts or columns 22 disposed at either end of base or frame member 2 and which upwardly project from the base or frame member. The second posts or columns serve to secure L-shaped support plates 24 which include an upwardly extending flange member 26. Support plates 24 are, in turn, secured to the second posts or columns 22 by fastener members 28.

Upwardly extending flange members 26 have attached thereto an indexing plate 30 provided with upwardly projecting fingers 32 with groove elements 34 disposed therebetween. Indexing plates 30 are adjustably secured to upwardly extending flange members 26 by way of fastener members 38 which pass through apertures 36 provided in indexing plates 30. An arm or post 40 is rigidly secured to an edge portion of abutment member 20 disposed on indexing carriages 4 to allow for selective disposition or indexing of indexing carriages 4 with respect to one another and to, in turn, provide for high precision alignment of the object 5 with respect to the cutting elements, described hereinbelow, of the notching mechanism 1. Indexing carriages 4 are also capable of supporting a plurality of objects which are stacked together so as to be fed into notching mechanism 1 for simultaneous notching in the manner shown in FIG. 5.

The notching or cutter assembly of the notching mechanism 1 includes a raised platform 42 which supports the end portion of support plates 24 opposite to that supported by second posts or columns 22, as best shown in FIG. *3a*. Raised platform 24 is also centrally disposed on base or frame member 2 and is disposed above a bore or cavity 44 in base or frame member 2.

Figure 3A:
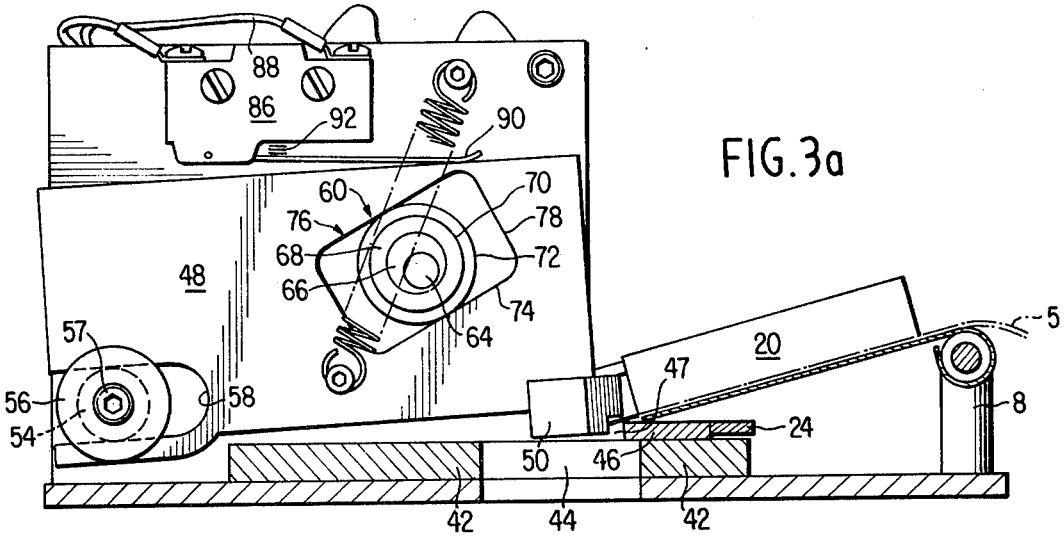
Figure 3B:
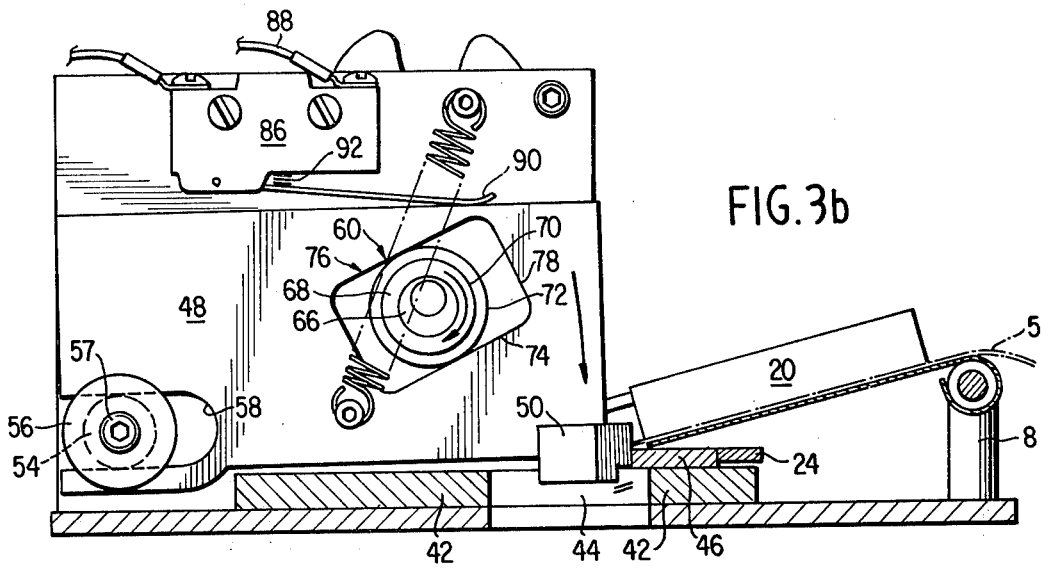
Figure 3C:
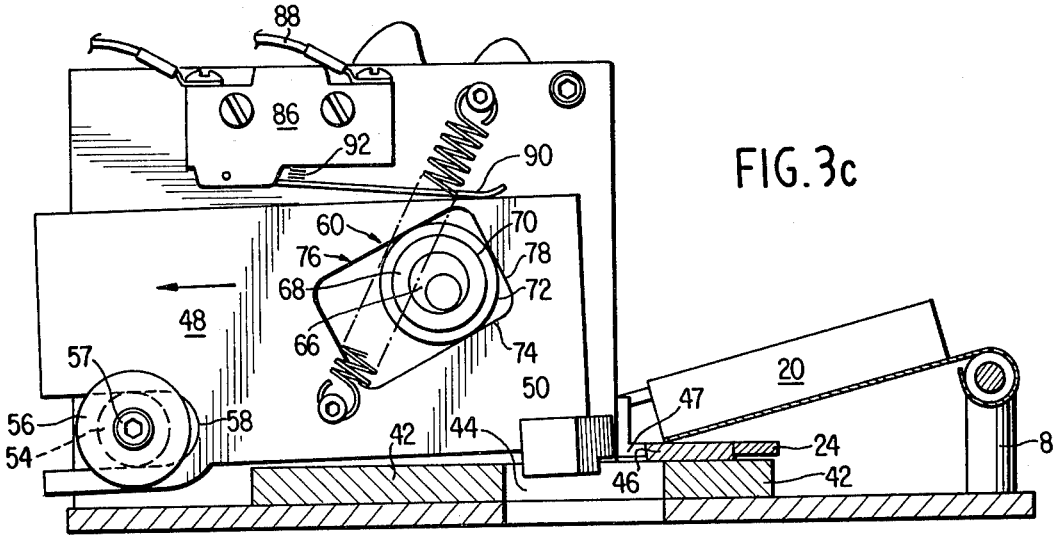

A fixed cutter member in the form of a plate element or die 46 is secured to raised platform 42 by conventional fastener members and includes a wedge shaped notch element 47 which is disposed over bore or cavity 44 as best shown In FIG. 3. Evenso, the present invention is not limited to a wedge shaped notch in cutter member 46 but may be of any desirable shape for the purpose of providing a cutting edge.

A carriage member 48 is also provided adjacent to bore or cavity 44 and cutting member 46 and has attached thereto a cutter blade or punch element 50 which is secured in a conventional manner by upwardly projecting fastener members to carriage 48. Cutter blade 50 is shaped to correspond to wedge shaped notch 47 but again may be of any desirable shape so as to operatively cooperate with shaped notch 47. Carriage 48 is secured to an upright 52 vertically upwardly projecting from the horizontal plane of base or frame member 2 and serves to support carriage 48 and, in turn, cutter blade 50 for cooperative engagement of cutter blade 50 with wedge shaped notch 47 at a point directly above bore or cavity 44 of base or frame member 2. Upright 52 also has attached thereto bearing member 54 which is operatively disposed within an open ended groove or slot 58 provided in carriage 48. An end portion of bearing member 54 has a washer element 56 made of plastic or any suitable material attached thereto by fastener member 57 so as to interpose washer 56 between fastener member 57 and groove or slot 58 provided in carriage 48. Groove or slot 58 extends parallel to the longitudinal axis of carriage 48 and is further disposed along a lower portion of carriage 48 opposite the end of carriage 48 supporting cutter blade or punch member 50. Bearing member 54 allows for rearward shifting of carriage 48 along the longitudinal axis thereof, as shown in FIG. 3.

Carriage 48 also includes a rectangularly shaped orifice 60 such that the longitudinal axis of orifice 60 forms an inclined angle with respect to the longitudinal axis of carriage 48. An electric motor 62 is secured to the side of upright 52 opposite that which serves to support carriage 48 and includes a drive shaft 64 which passes through upright 52 through an opening (not shown) so that the exposed end of drive shaft 64 is disposed within rectangular orifice 60.

An eccentric cam 66 is secured to the exposed end portion of drive shaft 64 and is, in turn, surrounded by ball bearing 68 fixedly secured to cam 66. Ball bearing 68 also includes an axially offset outer surface 72 and inner surface 70 with outer surface 72 being located adjacent to upright 52. Inner surface 70 has a diameter smaller than that of outer surface 72. The diameter of outer surface 72 being only slightly smaller than the width dimension of rectangular orifice 60. The lower orifice surface 74 of rectangular orifice 60 is biased in a direction towards cutter blade or punch 50 upon rotation of drive shaft 64, eccentric cam 66, ball bearing 68, and, in turn, outer surface 72. Similarly, during a complete cycle or revolution of drive shaft 64, orifice upper surface 76 of rectangular orifice 60, disposed parallel to and above orifice lower surface 74, is upwardly and rearwardly biased by outer surface 72. As a result, a vertical reciprocable force is applied to cutter blade or punch 50 by means of carriage 48, as clearly shown in FIG. 3.

Upright 52 is further provided with an upper securing member 78 outwardly projecting from upright 52 and disposed above carriage 48. A lower securing member 79 is attached to carriage 48 at a point below and rearwardly offset from the position of upper securing member 78. A biasing member (spring) 80 is connected between upper and lower securing members 78 and 79, respectively, so as to provide a forward biasing of carriage member 48 and, in turn, cutter member 50 for operative engagement of cutter member 50 with cutter member 46 and for self adjustment. (Biasing member 80, as shown in FIG. 1, is a coiled spring although any conventional biasing member can be utilized in the present invention).

The electrical system utilized in connection with the embodiment of FIG. 1 is schematically illustrated in FIG. 4 and includes a conventional power source 82 which is operably connected to control switch 84 and to a microswitch 86 which is secured to upright 52 at a point above the carriage 48. Microswitch 86 is operably connected by wires 88 to power source 82 as well as motor 62 and includes a microswitch arm 90. Microswitch arm 90 operatively engages the upper surface portion 49 of carriage 48 during a single cycle or revolution of drive shaft 64, eccentric cam 66, ball bearing 68, and outer surface 72 and serves to interrupt the electrical circuit of FIG. 4 after completion of a single revolution of drive shaft 64 of motor 62.

In operation, indexing carriages 4 are initially selectively indexed by arm or post 40 into the selected groove element 34 of indexing plates 30. An object 5 to be notched is then manually placed on indexing carriages 4 with the color coded edge portion 7 being disposed between the lower cutting edge of cutting member 50 and the upper cutting edge of cutting member 46. Control switch 84 is subsequently activated and, in turn, actuates motor 62 which serves to revolve drive shaft 64, eccentric cam 66, ball bearing 68, and outer surface 72 of ball bearing 68. During a complete cycle or revolution of drive shaft 64 and eccentric cam 66, outer surface 72 engages lower orifice surface 74 so as to provide a downward and forward biasing force to cutting member 80. As a result, the downward disposition of carriage member 48 serves to reciprocate cutting member 50 and to cooperatively engage cutting member 50 with cutting member 46 and provide a notch 6 in the object 5. During the latter portion of the cycle or revolution of drive shaft 64, outer surface 72 engages upper orifice surface 76 so as to bias carriage 48 in an upwardly and rearwardly direction and to actuate microswitch arm 90 of microswitch 86 which serves to interrupt supply of power to motor 62 and limit the number of cycles or revolutions to a single cycle or revolution. Even so, should an operator wish to operate the notching mechanism with continuous or uninterrupted cycling of drive shaft 64, control switch 84 need only be held in a depressed or continuously operable position so as to override microswitch 86.

During the actual notching or cutting of object 5, biasing member 80 serves to forwardly bias carriage 48 as well as cutting member 50 and thus provides a self-adjusting characteristic with respect to cooperation of the cutting members. Moreover, the carriage 48 serves to provide a reciprocation of cutting member 50 via drive shaft 64, eccentric cam 66 and outer surface 72 of ball bearing 68. It can thus be seen that the present invention provides for an eccentric cam assembly which engages the carriage member so as to automatically reciprocably drive cutting member 50 during a single revolution or continuous revolutions of the eccentric cam 66.

The present invention is also characterized by an overload response capability when a plurality of objects are simultaneously inserted between the cutting members for notching more objects than the notching mechanism can operably accommodate. Under these conditions, and as shown in FIG. 3, the cutting or shearing force of the notching mechanism, and in particular the cutting force supplied by motor 62, eccentric cam 66 and outer surface 72 is less than the cutting force necessary to notch the plurality of objects. At this point, carriage 48 is shifted longitudinally and rearwardly such that cutter member 50 cannot operatively engage with cutter member 46. Carriage member 48 is rearwardly shiftable so as to allow for a complete cycle or revolution of the notching mechanism and a return to its initial stage as shown in FIG. 3.

Figure 7A:
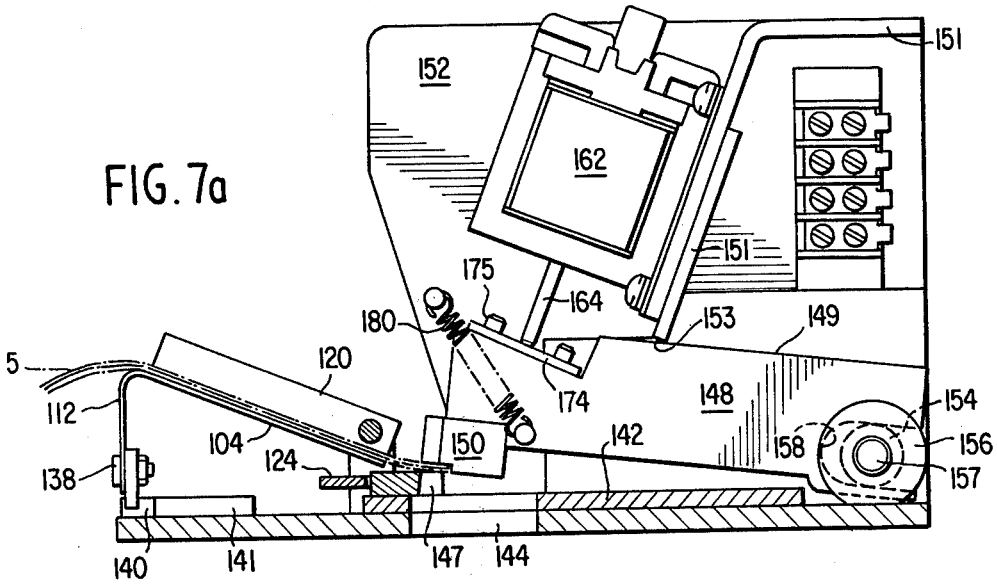
Figure 7B:
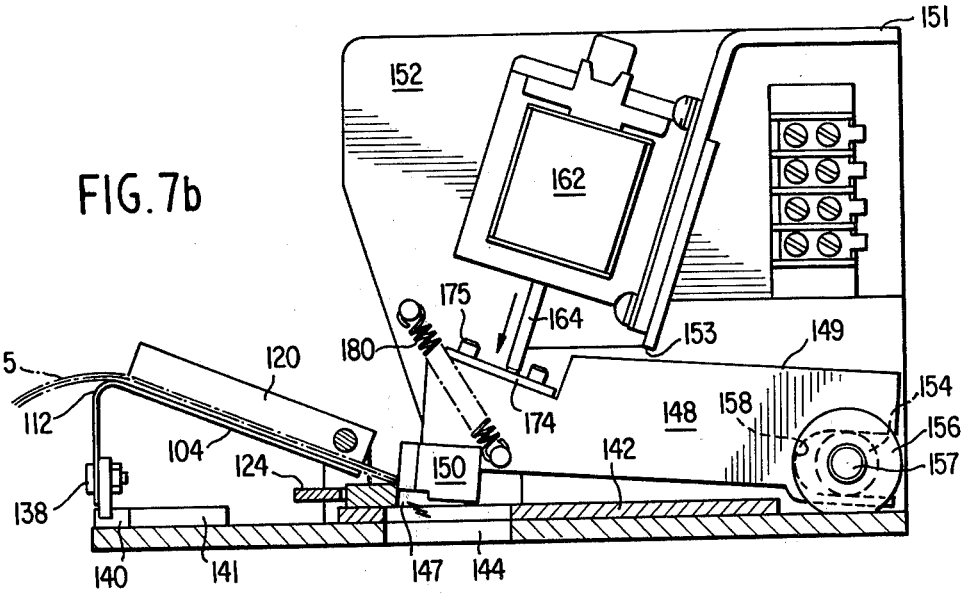

FIGS. 6 and 7 illustrate a second embodiment of the present invention with designated reference numerals corresponding to those of the embodiment of FIG. 1 yet appearing in a 100 series. Notching mechanism 101 is provided with a similar base or frame member 102 upon which is secured vertically projecting posts or columns 108 between which is mounted a rod member 110. A single indexing carriage 104 is mounted at one end of rod member 110 with abutment members 120 being provided at either end of the indexing carriage 104. Rod member 110 is disposed within openings 121 provided in abutment members 120 so as to allow for a slidable mounting of indexing carriage 104 on rod member 110. Indexing carriage 104 also has a downward extending curved flange 112 provided at the end opposite to the end mounted to rod member 110.

A single L-shaped support plate 124 is also horizontally supported above base or frame member 102 by fasteners 128 provided at either end of support plate 124.

Downwardly extending curved flange 112 is further provided along the lower edge thereof with fasteners 138 for securing an indexing plate 130 which includes downwardly projecting finger members 132 with groove elements 134 disposed therebetween. Arm or post member 140 is also disposed directly beneath indexing plate 130 for engagement therewith and forms an extension of plate 141 which is secured to base or frame member 102. A raised platform 142 is also mounted on base or frame member 102 for supporting the inner end portions of support plate 124 and surrounds bore or cavity 144 provided in the central portion of base or frame member 102. A cutter member in the form of a plate or die is fixedly secured to raised platform 142 in a conventional manner and is disposed adjacent to indexing carriage 104 and projects over bore or cavity 144.

Upright 152 projects vertically upward from the center portion of base or frame member 102 and is disposed adjacent to bore or cavity 144. Upright 152 also includes an L-shaped flange member 151 perpendicularly oriented to the plane of upright 152 and includes a lower edge portion 153.

Carriage 148 is also secured to upright 152 by means of bearing member 154, washer member 156 and fastener member 157 with bearing member 154 being disposed within a groove or slot 158 provided with a wall 159 similar to that of the embodiment of FIG. 1. Also, cutter member 150 is conventionally secured to the front portion of carriage 148 for operative engagement with fixed cutter member 146 and wedge shaped notch 147.

The upper surface 149 of carriage 148 disposed above cutting member 150 is provided with a notch for securely mounting a contact plate 174 by means of conventional fasteners 175. Contact plate 174 is operatively engaged with plunger 164 of solenoid 162 upon actuation of the solenoid to project plunger 164 downwardly and provide a downward shearing or cutting force to cutting member 150 via carriage 148 as well as providing a forwardly biasing direction of carriage 148 in the direction of cutting member 146. Solenoid 162 is operatively connected to an electrical circuit similar to that shown in FIG. 4 of the present invention with the exception of microswitch 86 and eccentric cam 66 so as to provide a power source 82 connected to a control switch which is, in turn, connected to solenoid 162 and cutter 150 via plunger 164, contact plate 174 and carriage 148.

In operation, the position of indexing carriage 104 is initially manually adjusted so as to provide the desired location with respect to cooperating cutting members 146 and 150. An object 5 to be notched is then placed on the indexing carriage with the color coded edge portion 7 being disposed between the cutting edges of cutting members 146 and 150 and with the side portion of object 5 engaging abutment members 120. Control switch 84 is then actuated to provide electric current to solenoid 162 for downwardly projecting plunger 164 so as to operatively engage control plate 174 which, in turn, downwardly biases carriage 148 and cutter member 150 so that cutter member 150 cooperatively engages fixed cutting member 146 and thus forms notch 6 in object 5. During the course of the above-described notching operation, biasing member 180 serves to forwardly bias carriage 148 so as to allow for cooperative engagement between cutting members 150 and 146 as well as providing a self-adjusting blade characteristic.

During an overload condition similar to that described with respect to the first embodiment, carriage 148 is shifted rearwardly along the longitudinal axis of carriage 148.

The upward disposition of carriage 148 prior to the above-described notching operation is such that the upper surface 149 of carriage 148 engages the lower edge 153 of L-shaped flange 151 and thus limits the upper disposition of plunger 164.

Figure 7C:
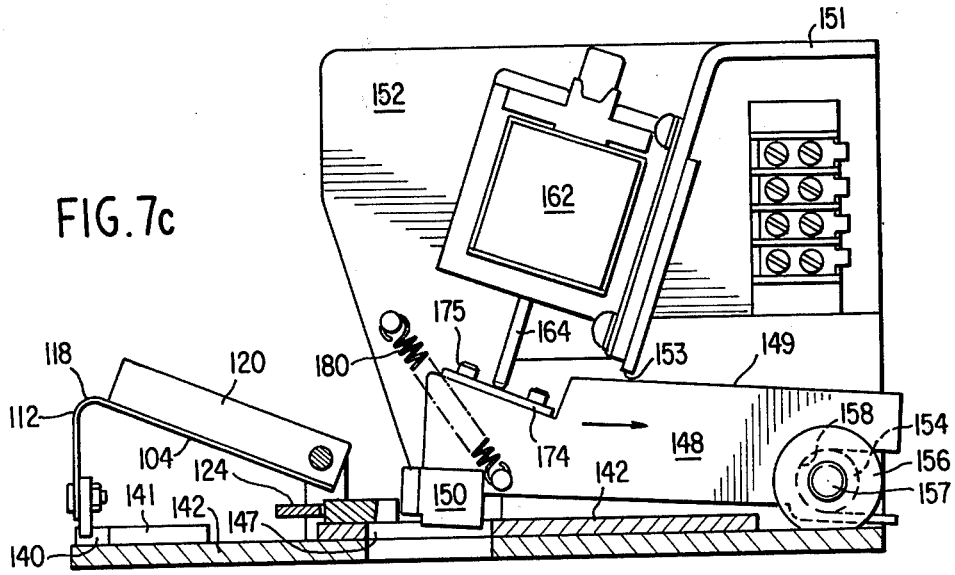

Control switch 84 allows for selective cycling of solenoid 162 so as to provide a single cycle for operatively engaging carriage 148 via plunger 164 and contact plate 174 through the disposition of cutting member 150. Moreover, contact plate 174 is rigidly secured only to carriage 148 and is inclined with respect to the longitudinal axis of carriage 148 in a manner similar to that of notch 160 so as to allow for a rearward disposition of contact plate 174 with respect to plunger 164 during an overload condition as described hereinabove and as shown in FIG. 7*c*.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A notching mechanism which comprises:

a base;

an upright support secured to and vertically projecting from said base;

means for supporting an object to be notched mounted on said base adjacent to said upright support;

first and second cooperating cutting members, said first cutting member being fixedly secured to said base and said second cutting member being connected to said upright support;

means for reciprocating said second cutting member, mounted to said upright support, so as to operatively cooperate with said first cutting member and thereby form a notch in said object; and means for biasing said first and said second cutting members into cooperating engagement and means for allowing shifting of said second cutting member from cooperating engagement with said first cutting member when an overload condition exists wherein said means for biasing said first and second cutting members includes a first securing member connected to said upright support, a second securing member connected to said means for reciprocating said second cutting member and a spring member interconnecting said first and second securing members.

2. A notching mechanism as set forth in claim 1, wherein said means for reciprocating said second cutting member comprises:

a carriage member to which said second cutting member is operatively secured, including an orifice provided therein, and cam means disposed within said orifice for engaging said carriage member so as to automatically reciprocably drive said second cutting member during a revolution of said cam means.

3. A notching mechanism as set forth in claim 1, wherein said support means comprises:

an axially shiftable indexing carriage operatively connected to means for selectably indexing and for releasably securing said indexing carriage in a selected position adjacent said first and second cooperating cutting members.

4. A notching mechanism as set forth in claim 2, which further comprises:

switch means operably connected to said cam means so as to selectively cycle said cam means through a single revolution upon actuation of said switch means.

5. A notching mechanism as set forth in claim 4, wherein said switch means includes means for continuously cycling said cam means through a plurality of revolutions.

6. A notching mechanism as set forth in claim 1, wherein said means for reciprocating said second cutting member comprises:

a carriage member to which said second cutting member is operatively secured, and;

means for operatively engaging said carriage member so as to reciprocably drive said second cutting member.

7. A notching mechanism as set forth in claim 6, wherein said support means comprises:

an axially shiftable indexing carriage operatively connected to means for selectably indexing and for releasably securing said indexing carriage in a selected position adjacent said first and second cooperating cutting members.

8. A notching mechanism as set forth in claim 6, which further comprises:

switch means for automatically selectively cycling said means for operatively engaging said carriage through an upper and lower disposition.

9. A notching mechanism which comprises:

a base;

an upright support secured to and vertically projecting from said base;

means for supporting an object to be notched mounted on said base adjacent to said upright support;

first and second cooperating cutting members, said first cutting member being fixedly secured to said base and said second cutting member being connected to said upright support;

means for reciprocating said second cutting member, mounted to said upright support, so as to operatively cooperate with said first cutting member and thereby form a notch in said object; and means for biasing said first and said second cutting members into cooperating engagement and means for allowing shifting of said second cutting member from cooperating engagement with said first cutting member when an overload condition exists wherein said means for reciprocating said second cutting member comprises a carriage member to which said second cutting member is operatively secured and means for operatively engaging said carriage member so as to reciprocably drive said second cutting member and wherein said carriage member includes a notched surface, inclined with respect to the longitudinal axis of said carriage member against which said means for operatively engaging said carriage is disposed during cutting action of said cooperating first and second cutting members.

* * * * *